US005768670A

United States Patent [19]

Enomoto et al.

[11] Patent Number: 5,768,670

[45] Date of Patent: Jun. 16, 1998

[54] DEVELOPER REGULATING MEMBER HAVING THERMOPLASTIC RESIN LAYERS PROVIDED ON BOTH SIDES OF A RUBBER MEMBER, METHOD OF MANUFACTURING THE SAME, AND DEVELOPING DEVICE USING THE SAME

[75] Inventors: Naoki Enomoto, Susono; Hiroshi Sasame, Numazu; Toru Ishigaki, Ibaraki-ken; Tetsuya Kobayashi; Yoshiro Saito, both of Numazu; Arihiro Yamamoto, Tokyo, all of Japan

[73] Assignee: Canon Kabushiki Kaisha, Tokyo, Japan

[21] Appl. No.: 611,858

[22] Filed: Mar. 6, 1996

[30] Foreign Application Priority Data

Mar. 8, 1995 [JP] Japan ..... 7-048470

[51] Int. Cl.[6] ..... G03G 15/08

[52] U.S. Cl. ..... 399/284; 427/409

[58] Field of Search ..... 355/245, 251, 355/253, 259; 118/653, 657, 261; 427/407.1, 409; 428/545; 399/274, 284, 267; 156/583.1, 298

[56] References Cited

U.S. PATENT DOCUMENTS

| | | | |
|---|---|---|---|
| 4,628,019 | 12/1986 | Suematsu et al. | 430/106.6 |
| 4,639,384 | 1/1987 | Umemoto et al. | 427/409 X |
| 5,004,650 | 4/1991 | Ashizawa et al. | 427/409 X |
| 5,177,537 | 1/1993 | Okano et al. | 355/259 |
| 5,196,888 | 3/1993 | Matsuda et al. | 355/251 |
| 5,319,337 | 6/1994 | Matsunari et al. | 399/267 X |
| 5,325,583 | 7/1994 | Shimizu et al. | 156/298 X |
| 5,353,104 | 10/1994 | Kato et al. | 355/259 |
| 5,391,253 | 2/1995 | Howell et al. | 156/583.1 |
| 5,519,472 | 5/1996 | Ojima et al. | 118/657 X |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

This specification discloses a developer regulating member and a developing device provided with this developer regulating member. The developer regulating member is provided with a blade having a rubber base member and thermoplastic resin layers provided on the both surfaces of the rubber base member, and a support member adhesively secured to one surface of the blade.

10 Claims, 4 Drawing Sheets

DEVELOPER REGULATING MEMBER HAVING THERMOPLASTIC RESIN LAYERS PROVIDED ON BOTH SIDES OF A RUBBER MEMBER, METHOD OF MANUFACTURING THE SAME, AND DEVELOPING DEVICE USING THE SAME

BACKGROUND OF THE INVENTION

1. Field of the Invention

This invention relates to a developer regulating member having rubber elasticity, a developing device using this developer regulating member, and a method of manufacturing this developer regulating member.

2. Related Background Art

In image forming apparatuses such as electrophotographic type copying apparatuses and printers, there has been employed often a developing device using a non-magnetic one-component or magnetic one-component toner. An example of a one-component developing type developing device used in electrophotographic type image forming apparatuses is shown in FIG. 7 of the accompanying drawings.

As shown, this developing device is provided with a developing chamber 102 having an opening portion 103 in the portion thereof opposed to a photosensitive drum 101, and a toner container 114 containing a toner therein is disposed on the back of the developing chamber 102. Further, a partition wall 115 for partitioning the developing chamber 102 from the toner container 114 is provided. Also, an electrically conductive developer carrying member (hereinafter referred to as the developing sleeve) 110 is rotatably disposed in such a manner that a portion thereof is exposed in the opening portion 103, and is rotated in the direction of arrow during the developing operation to thereby convey the toner toward the photosensitive drum 101 while carrying the toner thereon.

The developing sleeve 110 is held with a gap of 50–500 μm with respect to the photosensitive drum 101 and is formed with a developing area for supplying the toner carried on the developing sleeve 110 toward the photosensitive drum 101. Further, the developing chamber 102 has contained therein a supply roller 112 for supplying the developing sleeve 110 with the toner conveyed from the toner container 114 by conveying means 111.

A developing bias voltage comprising an AC voltage superposed on a DC voltage is applied from a bias voltage source (not shown) to the developing sleeve 110 during the developing operation.

Above the developing sleeve 110, there is disposed a developer regulating member (hereinafter referred to as the developing blade) 113 for regulating the layer thickness of the toner carried on the developing sleeve 110. This developing blade 113 is mounted in the developing chamber 102.

During the developing operation, the conveying means 111 conveys the toner toward the supply roller 112 beyond the partition wall 115, and the toner is applied to the developing sleeve 110 by the supply roller 112 rotated in the direction of arrow. The developing sleeve 110 is rotated in the direction of arrow and the toner carried on this developing sleeve 110 is regulated into a predetermined layer thickness by the developing blade 113, whereafter it is conveyed to the above-mentioned developing area opposed to the photosensitive drum 101. In this developing area, an electric field is formed by the developing bias supplied from the bias voltage source to the developing sleeve 110, and by this electric field, the toner flies from the developing sleeve 110 toward a region on the photosensitive drum 101 on which an electrostatic latent image is formed, and adheres thereto, whereby the electrostatic latent image is made into a visible image.

Here, the blade 113 may desirably be formed of such a material that will positively give charges to the toner. For example, when the toner has the negative polarity, nylon or the like is preferable, and when the toner is charged positively, resin of fluorine line or the like is preferable, and a material charged to the polarity opposite to the polarity of the toner is preferable.

In the above-described developing device, however, we have found a new fact through our experiments and studies.

When a material such as nylon is used to form the developing blade 113, it is very difficult for the developing blade to uniformly bear against the developing sleeve 110 because resin is hard, and the coat of the toner becomes non-uniform. Therefore, irregularity occurred particularly to half-tone images. So, as shown in FIG. 8 of the accompanying drawings a resin layer 32 was formed on elastic rubber 31, and the function separation of providing uniform pressure by the elasticity of the rubber and effecting the charging of the toner by the resin material on the surface was performed.

As a result of a study further done in such a construction, there arose a problem that when the blade was made to bear against the developing sleeve 110 by only the elasticity of the rubber, the blade was deformed and desired blade pressure could not be obtained. So, for example, a support member of phosphor bronze or the like having elasticity was adhesively secured to the back of the rubber, whereby it became possible to stabilize blade pressure by the support member of phosphor bronze or the like, stabilize uniform pressure by the rubber, and stabilize the charging of the toner by the resin material on the surface.

Thereby, a considerably good level was reached, but the irregularity could not completely eliminated. In the past, even such level of performance was satisfactory, but in recent years, for example, in printers also, demand for graphic output has heightened and with the tendency toward color printing, it has become requisite to further improve the level of performance.

We have studied this point and as a result, have found the following fact.

When a support sheet metal (hereinafter referred to as the support member) of phosphor bronze or the like having elasticity is adhesively secured to the back of the rubber, minute air bubbles are created in the adhesively secured portion. These minute air bubbles cause a reduction in the planarity of that surface of the blade 113 which bears against the developing sleeve 110, and it becomes difficult for the blade to uniformly bear against the developing sleeve 110.

Therefore, the developing blade causes image irregularity to occur.

SUMMARY OF THE INVENTION

It is an object of the present invention to provide a developer regulating member having a support member adhesively secured to a rubber blade without air bubbles being created.

It is another object of the present invention to provide a developing device in which a layer thickness regulating blade bears against a developing sleeve.

It is still another object of the present invention to provide a developer regulating member having:

a blade having a rubber base member and thermoplastic resin layers provided on the opposite surfaces of said rubber base member; and a support member adhesively secured to one surface of said blade.

It is yet still another object of the present invention to provide a developing device having:

a developer carrying member carrying a developer thereon; and a developer regulating member biased toward said developer carrying member for regulating the quantity of developer on said developer carrying member;

said developer regulating member having a blade having a rubber base member and thermoplastic resin layers provided on the both surfaces of said rubber base member, and a support member adhesively secured to one surface of said blade.

It is a further object of the present invention to provide a method of manufacturing a developer regulating member having the steps of:

dip-coating the both surfaces of a rubber member with thermoplastic resin by the dip coating process;

drying the thermoplastic resin to thereby form a thermoplastic resin layer;

setting a support member relative to the thermoplastic resin layer; and melting the thermoplastic resin layer between the rubber member and the support member.

Further object of the present invention will become apparent from the following detailed description.

DESCRIPTION OF THE PREFERRED EMBODIMENTS

Some embodiments of the present invention will hereinafter be described with reference to the drawings.

Figure 1:
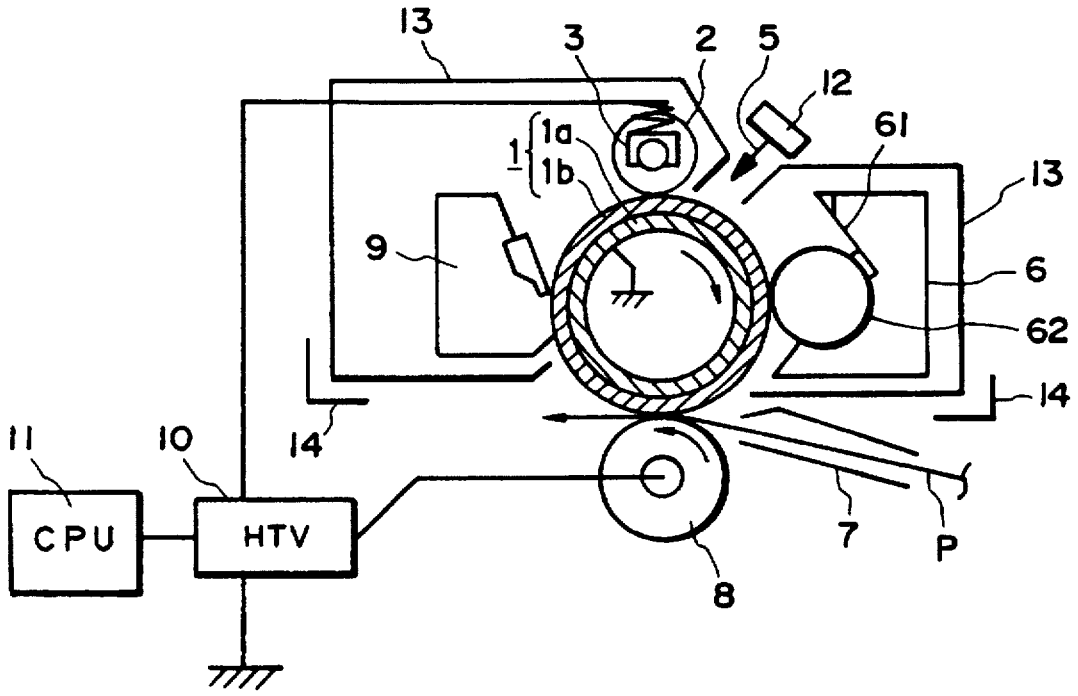
FIG. 1 schematically shows the construction of an image forming apparatus using an embodiment of the present invention.

FIG. 1 schematically shows the construction of an image forming apparatus to which an embodiment of the present invention is applied.

This image forming apparatus is an electrophotographic type laser beam printer.

A photosensitive drum 1 is one of a diameter 30 mm having a photosensitive layer 1*b* (the details of which will be described later) comprising an organic photoconductive material layer (OPC) formed on the outer peripheral surface of a grounded drum base member 1*a* made of an electrically conductive material such as aluminum, and is rotatively driven in the direction of arrow at a predetermined process speed (peripheral speed), e.g. 100 mm/sec. The reference numeral 2 designates a charging roller as a charging member, and a vibration voltage which is a voltage comprising a negative DC voltage superposed on an AC voltage is applied from a voltage source 10 to the mandrel 3 of this roller 2. At this time, scanning exposure by a laser beam 5 outputted from a laser scanner 12 on the basis of image information made into an electrical signal is effected on the surface of the rotating photosensitive drum 1 subjected to negative charging by the charging roller 2, whereby the potential of the exposed portion is attenuated and an electrostatic latent image is formed on the surface of the photosensitive drum 1. The latent image is reversely developed by the developing blade 61 of a developing device 6 with the aid of a negatively charged toner applied onto a developing sleeve 62.

On the other hand, a transfer material P is fed from a paper supply portion (not shown) through a guide 7 to the nip portion (transfer portion) between the photosensitive drum 1 and a transfer roller 8 as a transfer member in timed relationship with the toner image on the surface of the photosensitive drum 1, and the toner image on the surface of the photosensitive drum 1 is sequentially shifted (transferred) to the surface of the transfer material P by a transfer bias of the opposite polarity to the charging polarity of the toner which is applied from the voltage source 10 to the transfer roller 8.

The transfer material P having passed the transfer portion is separated from the surface of the photosensitive drum 1 and is introduced into fixating means, not shown, and is subjected to image fixation thereby and is outputted as an image formed matter (print).

The surface of the photosensitive drum 1 after the transfer material has been separated therefrom is subjected to the removal of an adhering contaminant such as untransferred toner by a blade type cleaner 9 which is a cleaning device and is made into a clean surface for repetitive use for image information. At this time, the blade pressure is 25 g/cm.

The reference numeral 11 denotes a control unit (CPU) for automatically setting the bias voltage source 10 for the charging roller 2 and the transfer roller 8 to predetermined application timing and a predetermined potential.

The charging roller 2, the developing device 6, the cleaner 9 and the photosensitive drum 1 are constructed as a process unit 13. This process unit 13 is removably mountable with respect to the laser beam printer which is an image forming apparatus, and the mounting or dismounting thereof may be accomplished by sliding, i.e., moving the process unit 13 along a guide 14 in a direction perpendicular to the plane of the drawing sheet of FIG. 1. The process unit 13, however, will suffice if it is provided with at least the photosensitive drum 1 and the developing device 6.

The developing device 6 will now be described in detail.

The developing device 6 contains a one-component nonmagnetic toner therein, and the toner carried on a developing sleeve 62 as a developer carrying member has its layer thickness regulated by a developing blade 61 which is a developer regulating member biased toward the developing sleeve 62. The toner on the tip end of the developing sleeve 62 carrying the toner thereon has triboelectricity imparted thereto chiefly by the friction thereof with the developing blade 61, and flies and adheres to the exposed low potential portion of the photosensitive drum by the action of an electric field in the developing portion.

The developer regulating member according to some embodiments of the present invention will now be described in detail.

[Embodiment 1]

Figure 2:
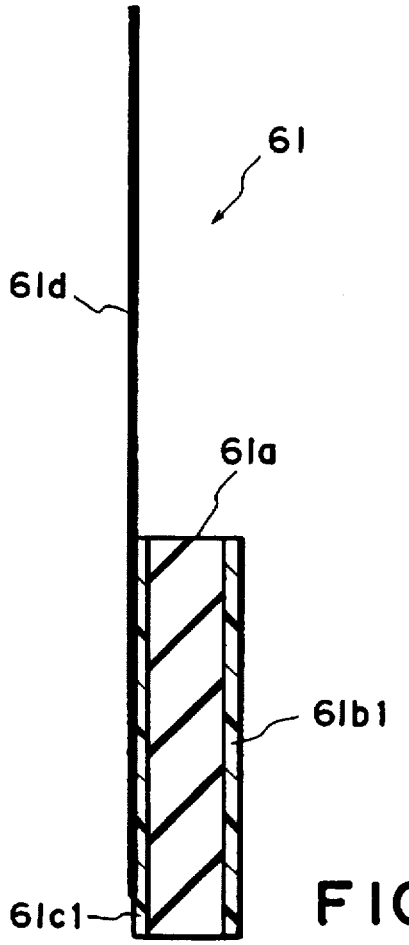
FIG. 2 is a cross-sectional view of a developer regulating member according to an embodiment of the present invention.

FIG. 2 is a view of the developing blade 61 showing a first embodiment of the present invention. The reference character 61*a* designates an elastic layer which is urethane rubber of rubber hardness 65° (by a Wallace hardness meter).

The reference character 61*b*1 denotes resin as a charge imparting layer for imparting charges of a predetermined polarity to the toner by the friction thereof with the toner, and in the present embodiment, a resin agent of nylon line (thermoplastic) is used as this resin, because a non-magnetic one-component toner of negatively chargeable property is used as the toner.

The reference character 61*c*1 designates a thermoplastic member provided between the rubber and a support member. The same resin as the charge imparting layer 61*b*1 is used as this thermoplastic member 61*c*1.

The reference character 61*d* denotes a support member, and phosphor bronze having a thickness of 150 μm is used as this support member 61*d*.

In the present embodiment, thermoplastic Amirun CM4000 (produced by Toray Co., Ltd.) is used as the surface resin of a blade 113.

Methyl alcohol 20% solution of Amirun CM4000 was prepared and was applied to the opposite surfaces of urethane rubber by the dip coating method, and was dried at 80° C. after air-dried. Also, the film thickness of nylon was 20 μm usually enabling film formation to be done uniformly.

At this time, Amirun CM4000 on the surface which does not bear against a developing sleeve 110 can be used for the thermoplastic member 61*c* provided between the rubber 61*a* and the support member 61*d*.

Figure 3:
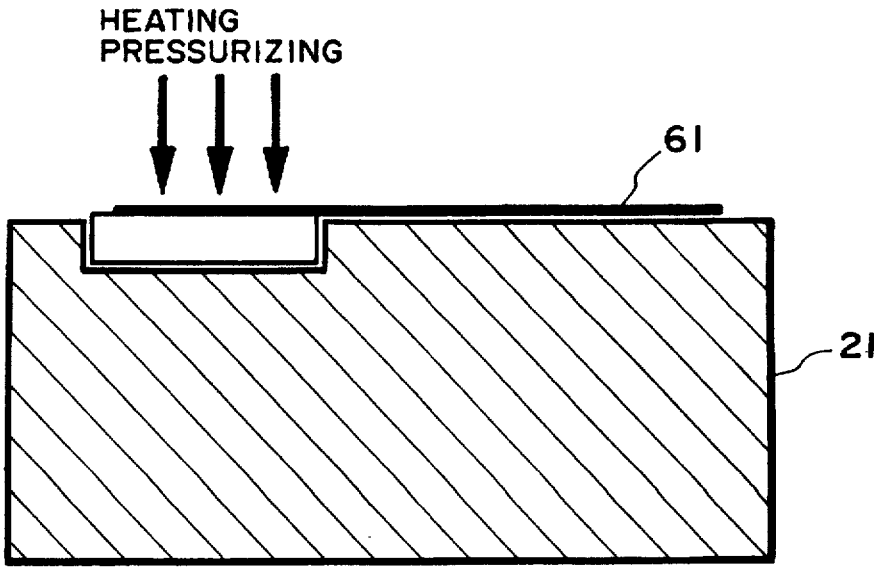
FIG. 3 is a view for illustrating the step of adhesively securing a rubber base member to a support member.

The rubber having this Amirun CM4000 film was cut into a predetermined size and as shown in FIG. 3, it was set on a bed 21 with the support member 61*d* above and heated and pressurized at 160° C. and with pressure of 0.5 kg/cm$^2$ for 30 sec. from the support member 61*d* side to thereby melt the thermoplastic member 61*c* between the rubber 61*a* and the support member 61*d*, whereupon the thermoplastic member 61*c* filled injuries and depressions in the surfaces of the rubber 61*a* and support member 61*d* and therefore, the rubber 61*a* could be adhesively secured to the support member 61*d* without any air bubble being created.

When a half-tone image was formed by the use of this developing blade, there could be obtained a uniform image free of irregularity.

[Embodiment 2]

Figure 4:
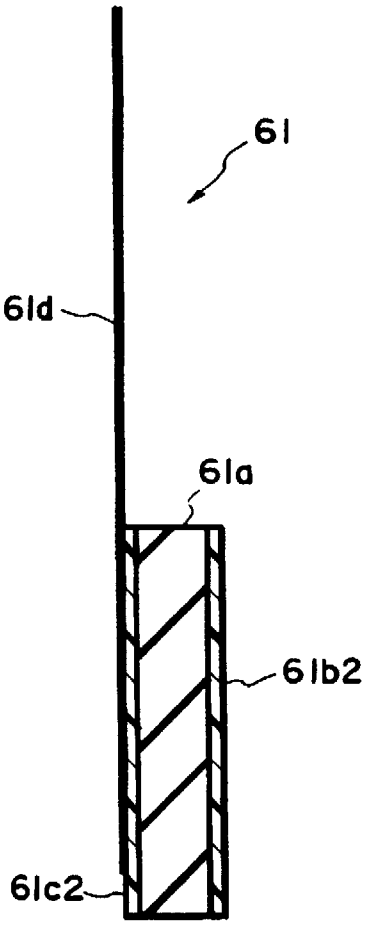
FIG. 4 is a cross-sectional view of a developer regulating member according to another embodiment of the present invention.
Figure 7:
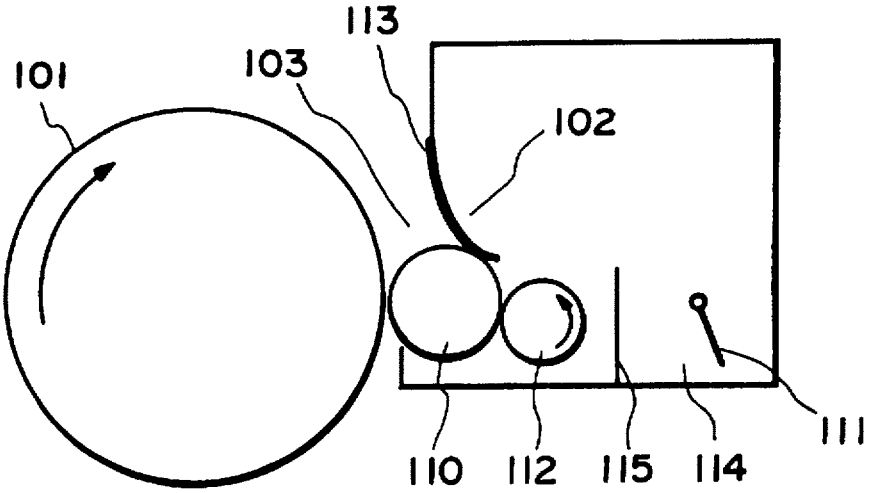
FIG. 7 is a cross-sectional view showing an example of a developing device.
Figure 8:
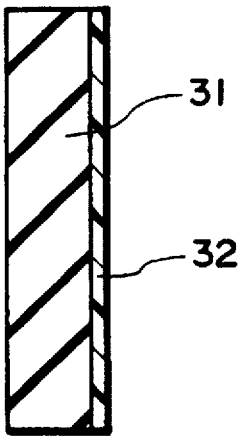
FIG. 8 PRIOR ART
FIG. 8 is a cross-sectional view of an elastic blade according to the prior art.

FIG. 4 is a view of the developing blade 61 showing a second embodiment of the present invention. In FIG. 4, members similar in construction and action to those in the first embodiment are given similar reference characters and need not be described.

The reference character 61*b*2 designates resin as a charge imparting layer and in the present embodiment, a resin agent of nylon line (thermoplastic) is used because a non-magnetic one-component toner of negatively chargeable property is used as the toner. Further, the strength of the resin is increased by the use of a cross link material to thereby prevent the abrasion of the resin during the continuous use of the developing device 6.

The reference character 61*c*2 denotes a thermoplastic member provided between the rubber and the support member. The same resin as the charge imparting layer 61*b*2 is used for this thermoplastic member.

In the present embodiment, as the surface resin of the developing blade 61, use is made of a mixture (hereinafter referred to as nylon-melamine) composed of 30 parts by weight of a cross linking agent (melamine formaldehyde resin) and 3 parts by weight of a catalyst (ammonium chloride) mixed with Amirun CM4000 (produced by Toray Co., Ltd.).

Methyl alcohol 20% solution of nylon-melamine was prepared and was applied to the opposite surfaces of urethane rubber by the dip coating method, and was dried at 80° C. after air-dried. The film thickness of nylon-melamine was 20 μm usually enabling film formation to be done uniformly. Now, nylon-melamine cross-links at 100° C. Accordingly, nylon-melamine does not cross-link even after air-dry and therefore, at this point of time, it is thermoplastic. At this time, nylon-melamine on the surface which does not bear against the developing sleeve 110 can be used for the thermoplastic member 61*c*2 provided between the rubber 61*a* and the support member 61*d*.

The rubber having this nylon-melamine film was cut into a predetermined size and as shown in FIG. 3, it was set on the bed 21 with the support member 61*d* above, and was heated and pressurized at 160° C. and with pressure of 0.5 kg/cm$^2$ for 30 sec. from the support member 61*d* side to thereby melt the thermoplastic member 61*c*2 between the rubber 61*a* and the support member 61*d*, whereupon the thermoplastic member 61*c*2 fills injuries and depression in the surface of the support member 61*d* and therefore, the rubber 61*a* could be uniformly secured to the support member 61*d* without any air bubble being created.

Further, in the present embodiment, this blade was left in an electric furnace kept at 100° C. for 8 hours to thereby effect the cross linking of nylon-melamine.

Now, the heating temperature during the adhesive securing is higher than the temperature during the cross linking, but the heating time during the adhesive securing is as short as 30 sec. and therefore, during the adhesive securing, the cross linking of nylon-melamine does not take place and the cross linking takes place only when the blade is left in the electric furnace.

Nylon-melamine becomes hard when it is cross-linked, and can prevent the abrasion of the charge imparting layer 61*b*2 during the continuous use of the developing device 6, but after cross-linked, it is not thermoplastic and therefore, even if heating and pressurizing are done, the rubber 61*a* cannot be adhesively secured to the support member 61*d*. However, as in the present embodiment, use is made of a material which is thermoplastic during the adhesive securing and can be cross-linked after the adhesive securing, whereby not only the rubber 61*a* can be uniformly secured to the support member 61*d*, but also the abrasion of the charge imparting layer 61*b*2 can be prevented.

[Embodiment 3]

Figure 5:
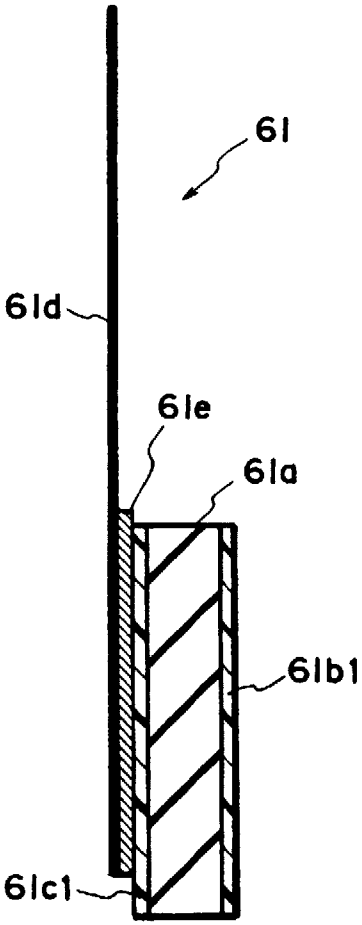
FIG. 5 is a cross-sectional view of a developer regulating member according to still another embodiment of the present invention.

FIG. 5 is a view of the blade 61 showing a third embodiment of the present invention. In this embodiment, members similar in construction and action to those in the first embodiment are given similar reference characters and need not be described.

In the present embodiment, a primer layer 61*e* (hereinafter referred to as the primer layer) comprising a thermoplastic member greater in the adhesive strength relative to the support member 61*d* than Amirun CM4000 is provided between urethane provided with Amirun CM4000 on the opposite surfaces thereof and the support member 61*d* to thereby increase the adhesive strength.

The reference character 61*b*1 designates resin as a charge imparting layer, and in the present embodiment, a resin agent of nylon line (thermoplastic) is used as this resin because a non-magnetic one-component toner of negatively chargeable property is used as the toner.

The reference character 61*c*1 denotes a thermoplastic member provided between the rubber 61*a* and the support member 61*d*. The same resin as the charge imparting layer 61*b*1 is used for this thermoplastic member.

In the present embodiment, the same nylon as that in Embodiment 1 was used by the same method and under the same conditions as in Embodiment 1, and the opposite surfaces of urethan rubber were coated with Amirun CM4000 and the rubber was cut into a predetermined size.

As the primer layer 61*e*, polyamide was then applied to a thickness of 5 μm to that surface of the support member 61*d* which was in contact with the thermoplastic member 61*c*1.

As shown in FIG. 3, the rubber was set on the bed 21 with the support member 61*d* having the primer layer 61*e* applied thereto above, and was heated and pressurized at 160° C. and with pressure of 0.5 kg/cm$^2$ for 30 sec from the support member 61*d* side.

The thermoplastic member 61*c*1 between the rubber 61*a* and the support member 61*d* and the primer layer 61*e* were melted by the heating and pressurizing and uniformly secured the rubber 61*a* to the support member 61*d* without creating any air bubble, while filling injuries and depressions in the surfaces of the rubber 61*a* and the support member 61*d*.

By providing the thermoplastic member, it was effected more sufficiently to fill injuries and depressions than when the rubber was secured by the primer alone, and the uniformity of the adhesive securing was further improved.

In the present embodiment, polyamide was used as the primer, but alternatively, polyester, polyethylene or the like may be used.

As a combination of the materials used for the charge imparting member and the primer layer, it is necessary that at the melting point of one material, the decomposition of the other material do not take place.

[Embodiment 4]

Figure 6:
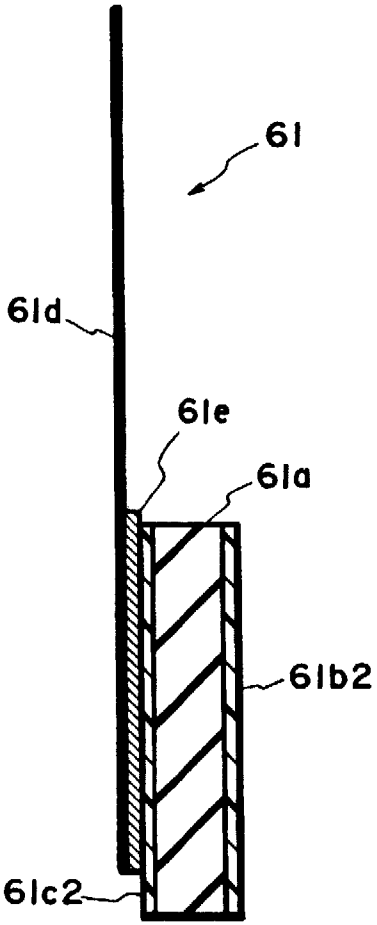
FIG. 6 is a cross-sectional view of a developer regulating member according to yet still another embodiment of the present invention.

FIG. 6 is a view of the developing blade 61 showing a fourth embodiment of the present invention. In this embodiment, members similar in construction and action to those in the first embodiment are given similar reference characters and need not be described.

In the present embodiment, between the urethane provided with nylon-melamine film on the opposite surfaces thereof shown in Embodiment 2 and the support member 61*d*, there was provided a primer layer 61*e* (hereinafter referred to as the primer layer) comprising a thermoplastic member greater in the adhesive strength relative to the support member 61*d* than this nylon-melamine to thereby increase the adhesive strength.

The reference character 61*d*2 denotes resin as a charge imparting layer and in the present embodiment, a resin agent of nylon line (thermoplastic) is used as this resin because a non-magnetic one-component toner of negatively chargeable property is used as the toner.

The reference character 61*c*2 designates a thermoplastic member provided between the rubber and the support member. The same resin as the charge imparting layer 61*bc* is used for this thermoplastic member.

In the present embodiment, the same nylon as that in Embodiment 2 was used by the same method and under the same conditions as in Embodiment 2 and the opposite surfaces of urethane rubber were coated with nylon-melamine, and the rubber was dried at 80° C. after air-dried, and was cut into a predetermined size.

Subsequently, as the primer layer 61*e*, polyamide was applied to a thickness of 5 μm to that surface of the support member 61*d* which was in contact with the thermoplastic member 61*c*2.

Then, as shown in FIG. 3, the rubber was set on the bed 21 with the support member 61*d* having the primer layer 61*e* applied thereto above, and was heated, and pressurized at 160° C. and with pressure of 0.5 kg/cm$^2$ for 30 sec. from the support member 61*d* side.

The thermoplastic member 61*c*2 between the rubber 61*a* and the support member 61*d* and the primer layer 61*e* were melted by the heating and pressurizing, and uniformly secured the rubber 61*a* to the support member 61*d* without creating any air bubble, while filling injuries and depression in the surfaces of the rubber 61*a* and the support member 61*d*.

Further, in the present embodiment, this blade was left in an electric furnace kept at 100° C., for 8 hours, and the cross linking of nylon-melamine was effected.

Nylon-melamine, when cross-linked, becomes hard and can prevent the abrasion of the charge imparting layer 61*b*2 during the continuous use of the developing device 6.

In the present embodiment, the primer layer 61*e* is provided and therefore, it is possible to secure the rubber to the support member 61*d* after nylon-melamine has been cross-linked. However, when the rubber was left in the electric furnace without being adhesively secured to the support member 61*d* and cross linking was effected, the urethane rubber became wavy due to the difference in heat contraction rate between nylon-melamine and the urethane rubber and it became impossible to flatly secure the rubber to the support member 61*d*.

Also, by providing the thermoplastic member 61*c*2, it was done more sufficiently to fill injuries and depressions than when the rubber was secured by the primer 61*e* alone, and the uniformity of adhesive securing was further improved.

As a combination of the materials used for the charge imparting member and primer layer, it is necessary that at the melting point of one material, the decomposition of the other material do not take place.

While the embodiments of the present invention have been described above, the present invention is not restricted to these embodiments, but all modifications are possible within the technical idea of the invention.

What is claimed is:

1. A developer regulating members comprising:

a rubber base member having first and second opposing surfaces;

thermoplastic resin layers respectively provided on said first and second surfaces simultaneously by dip coating;

an elastic metal plate adhesively secured to the first surface of said rubber base member via the thermoplastic resin layer disposed therebetween by heat and pressure; and a toner frictionally charged on the thermoplastic resin layer on the second surface of said rubber base member.

2. A developer regulating member according to claim 1, wherein said rubber base member comprises urethane rubber, and said thermoplastic resin comprises nylon.

3. A developer regulating member according to claim 1, further comprising a primer layer between said elastic metal plate and the thermoplastic resin layer.

4. A developer regulating member according to claim 1, wherein said rubber base member is thicker than the thermoplastic resin layers.

5. A developing device comprising:

a developer carrying member carrying a developer thereon; and a developer regulating member biased toward said developer carrying member for regulating the quantity of developer on said developer carrying member;

said developer regulating member having a rubber base member having first and second opposing surfaces;

thermoplastic resin layers respectively provided on said first and second surfaces simultaneously by dip coating;

an elastic metal plate adhesively secured to the first surface of said rubber base member via the thermoplastic resin layer disposed therebetween by heat and pressure; and said developer being frictionally charged on the thermoplastic resin layer on the second surface of said rubber base member.

6. A developing device according to claim 5, wherein the developer is a one-component developer.

7. A developing device according to claim 6, wherein the toner is a non-magnetic toner.

8. A developing device according to claim 6, wherein the toner is of a negatively chargeable property, said rubber base member comprises urethane rubber, and the thermoplastic resin layers comprise nylon.

9. A developing device according to claim 5, wherein said developer regulating member further has a primer layer between said elastic metal plate and the thermoplastic resin layer.

10. A developing device according to claim 5, wherein said rubber base member is thicker than the thermoplastic resin layers.

* * * * *

UNITED STATES PATENT AND TRADEMARK OFFICE

CERTIFICATE OF CORRECTION

PATENT NO. : 5,768,670

DATED : June 16, 1998

INVENTOR(S): NAOKI ENOMOTO ET AL.

It is certified that error appears in the above-identified patent and that said Letters Patent is hereby corrected as shown below:

ON COVER PAGE AT [57], ABSTRACT

Line 5, "the both" should read --both--.

COLUMN 2

Line 38, "not completely" should read --not be completely--.

COLUMN 3

Line 15, "the both" should read --both--;
Line 22, "the both" should read --both--.

COLUMN 5

Line 40, "61*c*" should read --61*c1*--.

UNITED STATES PATENT AND TRADEMARK OFFICE

CERTIFICATE OF CORRECTION

PATENT NO. : 5,768,670

DATED : June 16, 1998

INVENTOR(S): NAOKI ENOMOTO ET AL.

It is certified that error appears in the above-identified patent and that said Letters Patent is hereby corrected as shown below:

COLUMN 8

Line 14, "heated. and" should read --heated and--;
Line 53, "members" should read --member,--;
Line 63, "a toner frictionally charged" should read --wherein during use--;
Line 64, "member." should read --member charges a toner--.

Signed and Sealed this

Thirtieth Day of March, 1999

*Attest:*

Q. TODD DICKINSON

*Attesting Officer*

*Acting Commissioner of Patents and Trademarks*